US006758665B2

(12) United States Patent
Cichos

(10) Patent No.: US 6,758,665 B2
(45) Date of Patent: Jul. 6, 2004

(54) CONCRETE BLOCK VIBRATOR

(76) Inventor: Sigmund P. Cichos, 2519 S. 17th St., Niles, MI (US) 49120

( * ) Notice: Subject to any disclaimer, the term of this patent is extended or adjusted under 35 U.S.C. 154(b) by 174 days.

(21) Appl. No.: 10/010,027

(22) Filed: Dec. 6, 2001

(65) Prior Publication Data

US 2002/0071885 A1 Jun. 13, 2002

Related U.S. Application Data

(60) Provisional application No. 60/251,909, filed on Dec. 7, 2000.

(51) Int. Cl.[7] ..... B28B 1/08

(52) U.S. Cl. ..... 425/254; 425/355; 425/432; 425/456

(58) Field of Search ..... 425/254, 255, 425/432, 456, 355, 421, 424

(56) References Cited

U.S. PATENT DOCUMENTS

| | | | | | |
|---|---|---|---|---|---|
| 2,985,935 | A | * | 5/1961 | Wellnitz | 425/432 |
| 5,059,110 | A | * | 10/1991 | Allison et al. | 425/260 |
| 5,505,611 | A | * | 4/1996 | Aaseth et al. | 425/423 |
| 5,846,576 | A | * | 12/1998 | Braungardt et al. | 425/253 |
| 5,952,015 | A | * | 9/1999 | DeWyre et al. | 425/186 |

* cited by examiner

*Primary Examiner*—Robert Davis
*Assistant Examiner*—Thu Khanh T. Nguyen
(74) *Attorney, Agent, or Firm*—Botkin & Hall

(57) ABSTRACT

A vibrator device for use in a concrete block maker in which the mold box and the underlying pallet of the device reciprocate in opposite directions relative to each other, providing compaction of the concrete mix within the mold box as supported upon the pallet.

3 Claims, 3 Drawing Sheets

10
12
13
14
16
18
20
22
24
25
26
27
28
32
34
36
37
38
39
40
42
44
46

CONCRETE BLOCK VIBRATOR

CROSS REFERENCE TO RELATED APPLICATION

This is a Continuation of Provisional Application Serial No. 60/251,909, filed Dec. 7, 2000.

SUMMARY OF THE INVENTION

This invention relates to a vibrating device used in the production of concrete blocks.

In the production of concrete blocks, the green or uncured concrete mix is placed in a mold box upon a pallet. The block and pallet with the concrete mix or material are vibrated to cause compaction of the mix prior to curing. Thereafter, the mold box is separated from the compacted mix upon the pallet and the mix in block form is allowed to cure upon the pallet for eventual removal and use. U.S. Pat. Nos. 3,679,340; 4,036,570; and 4,095,925 owned by Besser Company of Alpeana, Mich., relate to concrete block molding machines and are incorporated herein by reference.

In this invention the vibrator is improved upon by incorporating a pair of eccentric drives which cause the independent movement of the pallet and the mold box toward and away from each other. This movement reduces the noise associated with the block making process and also improves compaction of the green or uncured concrete mix in the mold box and upon the pallet.

Accordingly, it is an object of this invention to provide a vibrator of improved operation for compacting a concrete mix in a block mold box.

Another object of this invention is to provide a vibrating device which is for the compaction of concrete material in concrete block making apparatus and which is of less noisy operation.

Other objects of this invention will become apparent upon a reading of the following description.

BRIEF DESCRIPTION OF THE DRAWINGS

A preferred embodiment of this invention has been chosen for purposes of illustration wherein.

DESCRIPTION OF THE PREFERRED EMBODIMENT

Figure 1:
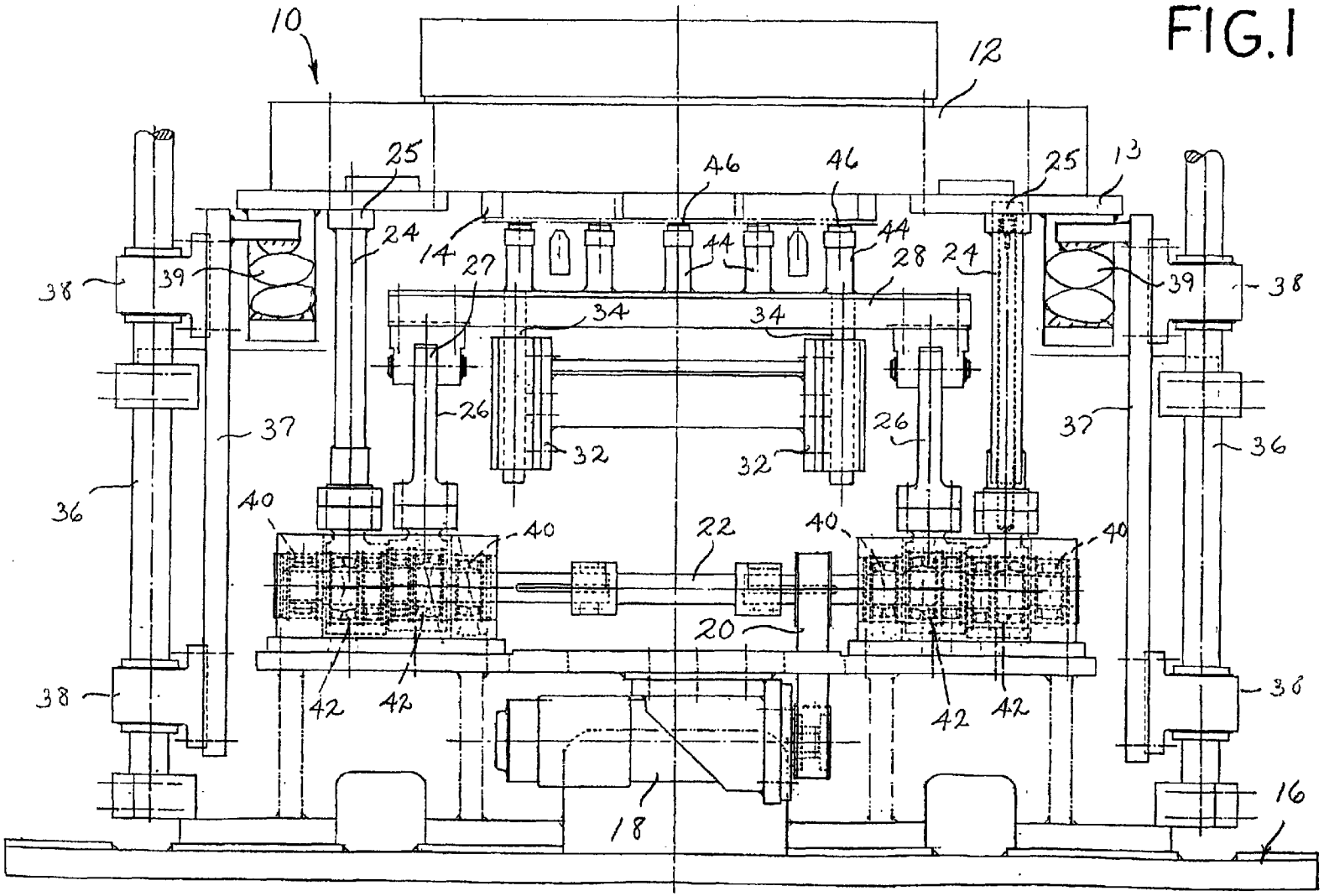
FIG. 1 is a front view of the vibrating device of this invention.

The preferred embodiment illustrated is not intended to be exhaustive or to limit the invention to the precise form described and disclosed. It is chosen and described in order to best explain the invention to enable one having ordinary skill in the art to utilize the invention.

The vibrator device 10 of this invention forms a part of the concrete block maker in which a concrete mix, usually in semi-dry form, is dumped into the mold box 12. The mold box 12 and underlying pallet 14 are then vibrated to compact and settle the mix. After use of device 10, the mold box which is open at both the top and the bottom is raised relative to pallet 14 upon which the compacted concrete mix rests. The compacted and formed block remains upon the pallet once the mold box is raised with the compacted block and pallet being removed to allow curing of the block.

Vibrator devise 10 includes a support frame 16 which houses a drive a motor 18. Drive motor 18, which is preferably of the servo type, controlled by an encoder, is connected by a gear belt and pulley drive 20 to a transverse drive shaft 22. A pair of telescopic connecting rods 24 are positioned outermost along drive shaft 22 and extend from the drive shaft to mold box 12. A pair of non-telescopic connecting rods 26, located interiorly of connecting rods 24, extend between drive shaft 22 and a pallet table 28 located under mold box 12. The upper end 25 of each connecting rod 24 is bolted to the mold box while the upper end 27 of each connecting rod 26 is pivotally connected to the pallet table 28.

Figure 2:
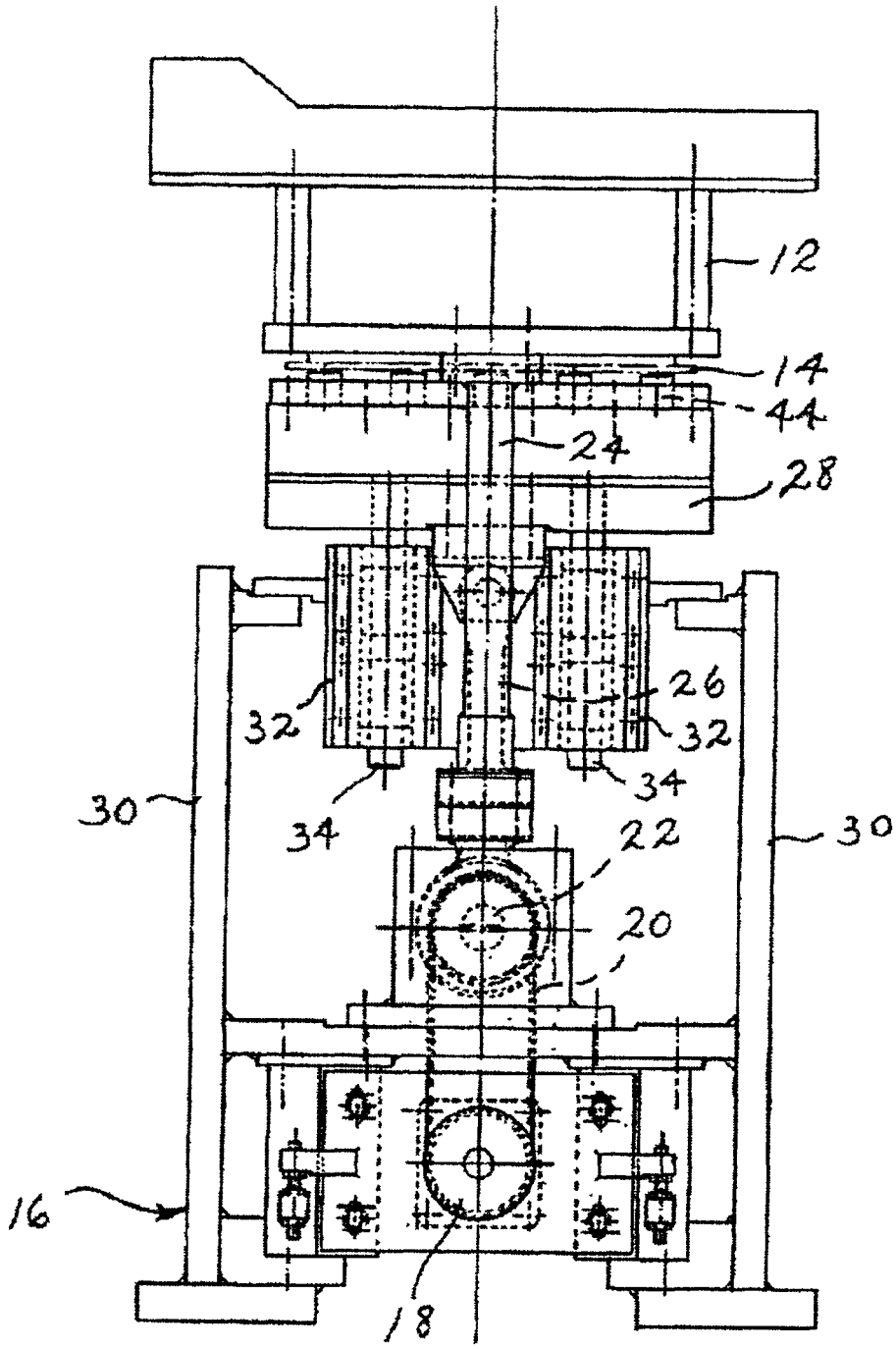
FIG. 2 is an end view of the vibrating device of this invention.
Figure 3:
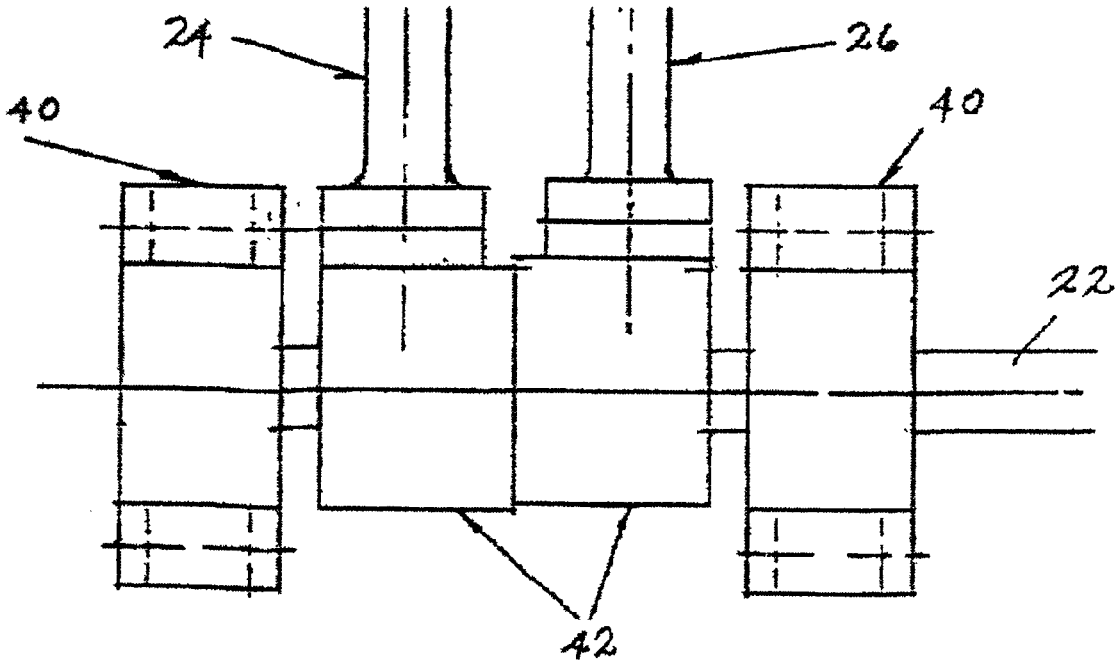
FIG. 3 is a fragmentary view of the eccentric drives used in the vibrating device of this invention.

Frame 16 includes upright extensions 30, seen in FIG. 2, which support fixed guides 32 forming part of the frame directly beneath a pallet table 28. Depending guide posts 34 attached to pallet table 28 fits slidably within guides 32 so as to anchor pallet table 28 against lateral movement while allowing vertical movement of the table relative to frame 16. Guide rods 36 attached to frame 16 each carry a lift part 37 which is mounted by guide block bushings 38 to its supporting guide rod. Each lift part 37 is attached to an air bag 39. Air bags 39 are in turn attached to mounting plates 13 of mold box 12 and serve to anchor the mold box against lateral movement and, with lift part 37 when raised through an actuator, such as a screw drive, shift the mold box upwardly off the compacted, uncured concrete block as it rests upon pallet 14. Air bags 39 due to being partially compressed which serve to hold rods 24 in their retracted positions as seen in FIG. 1 when lift parts 37 are lowered while still allowing reciprocating movement of the rods during rotation of shaft 22.

Drive shaft 22 is supported upon frame 16 by bearings 40 with each of the connecting rods 24, 26 being connected to the drive shaft by an eccentric in the form of a cam 42. Cams 42 cause connecting rods 24, 26 to reciprocate during rotation of drive shaft 22 in an up and down movement. The lobe of cam 42 connected to each connecting rod 24 is offset 180° from the lobe of cam 42 connected to each connecting rod 26 so that as mold box 12 is being raised by its connecting rods 24, pallet table 28 is being lowered by its connecting rods 26 during partial rotation of drive shaft 22, followed by the lowering of mold box 12 through its connecting rods 24 and the raising of pallet table 28 through its connecting rods 26 upon completed rotation of the drive shaft. Accordingly, upon rotation of drive shaft 22, and due to the design of the respective cams 42, mold box 12 and pallet table 28 experience vertical movement toward and away from each other.

A plurality of posts 44 extend upwardly as a part of pallet table 28 to support pallet 14 under mold box 12. The tips of posts 44 may include pads 46 formed of plastic material such as urethane. Alternatively, the pads may be formed of a magnetic material to cause the removable adherence of the metallic pallet during the vibratory operation of vibrating device 10. The vertical movement, caused by cams 42, of each of the mold box 12 and pallet table 28 and its supported pallet 14 is slight, preferably in the range of 0.050 inches. Thus the supported pallet 14 and mold box 12 move apart approximately 0.100 inches and are brought together to just touch or kiss during reciprocating movement of each of the respective mold box and pallet. The amount of movement between the mold box and the pallet can be adjusted or varied depending upon the consistency of the mix and desired compaction. This vibratory movement between the mold box and pallet causes improved compaction of the concrete mix and reduces the noise level of the vibratory device.

While not shown in this embodiment, suitable air mounts may be located between connecting rods 26 and pallet table 28 as well as between lift parts 37 and mold box 12 to further control vibrations as well as serving as a transfer medium through which the reciprocating vibratory movement of the connecting rods is imparted to the mold box and supported pallet. The duration of rotation of drive shaft 22 as well as the operating sequence of motor 18 will depend upon the type of semi-dry mix and the operating sequence of the block maker.

The invention above described is not to be limited to the details above given but may be modified within the scope of the appended claims.

I claim:

1. A vibrating device of for use in a concrete block maker, said vibrating device comprising a mold box and an underlying pallet table for supporting a pallet, said pallet and mold box forming a mold for a concrete mix, a frame supporting a drive member, said drive member connected to each of said mold box and said pallet table and constituting means for causing the individual reciprocating movement of said mold box and said pallet table, wherein the mold box and pallet table move toward and away from each other, said drive member including a drive shaft and first and second connectors, said first connector extending between said drive shaft and said mold box, said second connector extending between said drive shaft and said pallet table, said drive shaft including a first eccentric means associated with said first connector and a second eccentric means associated with said second connector, said first and second eccentric means for parting said reciprocating movement.

2. The vibrating device of claim 1 wherein said first connector includes two spaced first rods each having upper and lower ends, each first rod connected to said mold box at its said upper end, said first eccentric means including a first cam in driving engagement with each first rod at its said lower end, said second connector including two spaced rods each having upper and lower ends, each second rod connected to said pallet table at its said upper end, said second eccentric means including a second cam in driving engagement with each second rod at its said lower end.

3. The vibrating device of claim 2 wherein said drive member includes a motor for imparting rotation to said drive shaft.

* * * * *